US005939657A

United States Patent [19]

Morgado

[11] Patent Number: 5,939,657

[45] Date of Patent: Aug. 17, 1999

[54] SEMIAUTOMATIC PISTOL AND AMMUNITION

[76] Inventor: Ralph Gordon Morgado, 1825-A Addison Way, Hayward, Calif. 94545

[21] Appl. No.: 08/861,828

[22] Filed: May 23, 1997

[51] Int. Cl.[6] ..... F41A 9/17

[52] U.S. Cl. ..... 89/33.03; 89/157; 42/9

[58] Field of Search ..... 89/33.03, 155, 89/156, 157; 42/9

[56] References Cited

U.S. PATENT DOCUMENTS

| | | | |
|---|---|---|---|
| 3,222,989 | 12/1965 | Kamp | 89/155 |
| 3,782,242 | 1/1974 | Angell et al. | 89/33.03 |
| 3,997,994 | 12/1976 | Kastner et al. | 42/9 |
| 4,152,857 | 5/1979 | Ketterer | 42/88 |
| 4,348,941 | 9/1982 | Ketterer et al. | 89/155 |
| 5,259,319 | 11/1993 | Dravecky et al. | 102/447 |

FOREIGN PATENT DOCUMENTS

| | | | |
|---|---|---|---|
| 2419185 | 10/1975 | Germany | 89/33.03 |
| 3967 | 5/1903 | United Kingdom . | |

*Primary Examiner*—Stephen M. Johnson
*Attorney, Agent, or Firm*—Flehr Hohbach Test Albritton & Herbert LLP

[57] ABSTRACT

Semiautomatic pistol and ammunition in which the pistol has a grip adapted to be held in the hand of a shooter, a barrel extending in a forward direction from the grip, a magazine of cartridges positioned above the barrel, and an action located within the grip for firing cartridges through the barrel. Cartridges are transferred from the magazine down to the action, and spent cartridge cases are ejected down through the lower portion of the grip. The barrel intersects the grip below the top of the grip at an angle such that the barrel will be aligned axially with the forearm of the shooter when the grip is held in the hand with the top of the shooter's wrist level with the top of the forearm. The action includes a breech which is rotatable between rest and cocking positions, a chamber which rotates with the breech between battery and loading positions, a firing pin carried by the breech, and a rotatively mounted hammer which is moved to a cocked position by rotation of the breech. A cocking lever is located at the bottom of the grip, and loader is connected to the breech for loading cartridges from the magazine to the chamber when the chamber is in the loading position. The cartridge includes a case having a side wall and a head, a projectile having a side wall disposed coaxially about the side wall of the case and a hollow nose extending forwardly of the side walls, and a powder charge which fills substantially the entire region within the case and the projectile. The nose of the cartridge has a flat central area and a circular cutting edge extending peripherally of the central area.

32 Claims, 8 Drawing Sheets

SEMIAUTOMATIC PISTOL AND AMMUNITION

This invention pertains generally to firearms and cartridges and, more particularly, to a semiautomatic pistol and ammunition therefor.

The design of the semiautomatic pistol has not changed significantly since the introduction of the Colt .45 Model 1911 in the early 1900's. Since that time, others have made some minor modifications in the basic design, but nothing of a fundamental nature.

In the Model 1911 pistol, cartridges are stored in an ammunition clip which is inserted into the grip of the pistol. Cocking and firing of the gun are accompanied by movement of an external slide, and spent shells are ejected from the top of the gun where they can be distracting to the shooter. The slide travels a distance on the order of four inches each time the gun is fired, and this limits the cycle time or rate at which successive rounds can be fired. Sights are mounted on the moving slide, which makes aiming difficult, and the sliding mechanism and other parts of the action are subject to substantial wear and mechanical failure. These guns can be very dangerous to handle because it is difficult to determine, without firing the gun, whether there is a live round in the chamber when the clip is removed.

One of the most significant problems with the Model 1911 and other semiautomatic pistols heretofore provided is the tendency of the barrel or muzzle to rise when the gun is fired. This barrel rise, or anticipation thereof, causes inaccuracy during discharge and requires extra time for re-aiming between firings at a stationary target. When a number of rounds are fired in rapid succession, the barrel has a tendency to climb farther away from the target on each successive shot.

It is in general an object of the invention to provide a new and improved firearm and ammunition.

Another object of the invention is to provide a firearm and ammunition of the above character which overcomes the limitations and disadvantages of the prior art.

These and other objects are achieved in accordance with the invention by providing a firearm which has a grip adapted to be held in the hand of a shooter, a barrel extending in a forward direction from the grip, a magazine of cartridges positioned above the barrel, an action located within the grip for firing cartridges through the barrel, means for transferring a cartridge from the magazine to the action, and means for ejecting a spent cartridge case from the action through the lower portion of the grip. The magazine is aligned with the upper portion of the grip, and the axis of the barrel intersects the grip below the upper portion at an angle such that the barrel will be aligned axially with the forearm of the shooter when the grip is held in the hand with the top of the shooter's wrist level with the top of the forearm.

The action includes a breech block which is rotatable between rest and cocking positions, a chamber body which rotates with the breech block between battery and loading positions, a firing pin carried by the breech block, and a rotatively mounted hammer which is moved to a cocked position by rotation of the breech block. A cocking lever is located at the bottom of the grip, and loader is connected to the breech block for loading cartridges from the magazine to the chamber when the chamber body is in the loading position.

The cartridge includes a case having a side wall and a head, a projectile having a side wall disposed coaxially about the side wall of the case and a hollow nose extending forwardly of the side walls, and a powder charge which fills substantially the entire region within the case and the projectile. The nose of the cartridge has a flat central area and a circular cutting edge extending peripherally of the central area.

Figure 1:
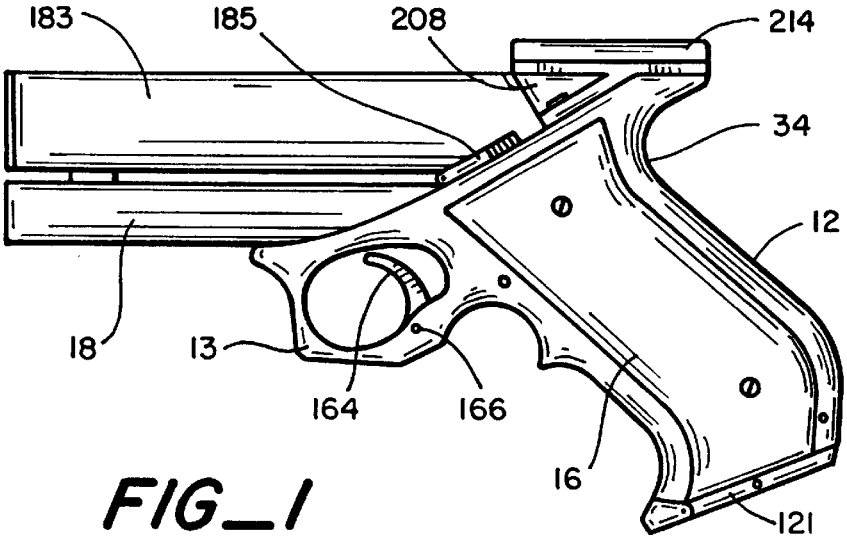
FIG. 1 is a side elevational view of one embodiment of a semiautomatic pistol incorporating the invention.

As illustrated in FIGS. 1–8, the pistol includes a receiver or frame 11 which comprises a body of rigid material such as a lightweight metal or a suitable plastic. The frame includes a grip 12 which is contoured to fit the hand of the shooter and a trigger guard 13 which is positioned in front of the grip. A cavity 14 formed in the grip to house the firing mechanism or action and opens through the left side of the grip. A decorative grip 16 mounted on the left side of the frame serves as a closure for the cavity and is held in place by screws 17.

A generally cylindrical barrel 18 is mounted in a fixed position on the frame. The barrel rests in a slot 19 above the trigger guard and extends into cavity 14 through an opening 21 in the receiver The barrel has a rearwardly facing annular shoulder 22 which abuts against a forwardly facing shoulder 23 at the rear of the slot, and a thread 24 which engages a corresponding thread 26 in the front flange 27 of an L-shaped bracket 28 at the front of the cavity. A locating pin 29 projects from the left side of the frame and engages an opening 31 in the side flange 32 of the bracket. The barrel is thus securely yet removably mounted, and barrels of different lengths can be interchanged simply by unscrewing one and screwing on another.

The grip and barrel are arranged to provide a natural and stable shooting posture and to completely eliminate muzzle rise when the gun is fired. The barrel extends from the grip at an angle on the order of 130–135 degrees so that the grip is inclined at an angle on the order of 45–50 degrees to the vertical when the barrel is in a horizontal position. This causes the top of the shooter's wrist to be aligned with the top of his forearm when he is holding the pistol in a shooting position, much as it would be if he were holding a flashlight. This has been found to be a more natural and stable posture for the shooter's wrist than having it cocked at an angle as it is with handguns of the prior art.

The arch of the shooter's hand (i.e., the portion between the thumb and forefinger) is received in a indented area 34 toward the top of the grip at the rear of the gun, with the axis of the barrel intersecting the grip below the indented area. The barrel is thus positioned below the tops of the wrist and forearm and directly in line with the forearm and the wrist of the shooter. With the barrel in this position, the kick-back or recoil force which occurs when the gun is fired is applied directly to the forearm, with no tendency for the barrel to rise as it would do if the barrel were positioned above the arm as it is in other handguns.

The action includes a chamber body 36, a breech block 37 and a hammer 38 which are all mounted in cavity 14. Chamber body 36 has a bore 39 for receiving the cartridge to be fired, and a pair of trunions 41 which are aligned along an axis 42 perpendicular to the axis of barrel 18. One of the trunions is received in a bearing 43 which is threadedly mounted in an opening 44 on the right side of frame 11, and the other is received in an opening 46 in the side flange 32 of bracket 28. The chamber body is in the form of a rotating ball, with a generally circular periphery 47 centered about the axis of the trunions and a generally flat surface 48 toward the rear.

A shell holder 49 holds a cartridge in chamber 39 until the cartridge has been fired and the case is ready to be expelled. The shell holder is mounted on a pin 51 which passes through aligned openings 52, 53 in the lower portion of the holder and in a pair of ears 54 which extend rearwardly from the flat side of the chamber body. The upper portion of the shell holder is biased in a forward direction by a spring 56 constrained between the lower portion of the shell holder and the chamber body. Forward travel of the shell holder is limited by abutment of the holder with the face of the chamber body around the bore. The upper edge 57 of the shell holder has an arcuate curvature for peripheral engagement with the case of a cartridge in the chamber.

Breech block 37 and hammer 38 are rotatively mounted on a shaft consisting of a screw 59 which extends between a hole 61 in the side flange of bracket 28 and a threaded hole 62 in the opposite side of frame 11. The screw has an unthreaded cylindrical body which serves as a pivot shaft, with the axis of the shaft being parallel to axis 42. The front portion of the hammer is narrower than the breech block and is positioned between a pair of arms or flanges 63 toward the front of the breech block, with the shaft passing through holes 64, 66 in the hammer and breech.

Chamber 36 is connected to breech 37 by a link 67 for rotation between battery and loading positions as the breech rotates between rest and cocking positions. In the battery position, bore 39 is aligned with the bore of the barrel, and the loading position, bore 39 is inclined at an angle on the order of 5–15 degrees to the vertical, with the barrel extending horizontally. The link includes pins 68, 69 which extend through holes 71, 72 in the chamber block and breech block, a fixed side plate 73 at one end of the pins, a removable side plate 74 toward the outer ends of the pins, and a retainer 76 which passes through cross bores 77 between the removable plate and the outer ends of the pins.

A firing pin 78 is mounted on a carrier 79 in a slotted opening 81 toward the rear of the breech block, with the pin extending through a bore 82 in the breech block which is in axial alignment with the bore in the chamber body when the action is in the battery position. The carrier is pivotally mounted on a pin 83 which passes through holes 84, 86 in the breech block and the lower portion of the carrier, and the firing pin has a spherical head 87 which snaps into a socket 88 toward the upper end of the carrier. The carrier has a lower surface 89 which is struck by the hammer to pivot the carrier and drive the firing pin in the forward direction into contact with the primer of a cartridge in the chamber. The firing pin is biased in a rearward direction, away from the chamber body, by a compression spring 90 which is disposed between the carrier and the breech block, with a stop 91 extending in a forward direction from the lower portion of the carrier for engagement with the breech block to limit rearward travel of the pin. A flange 92 on the firing pin abuts against an annular shoulder 93 on the breech block to limit forward travel of the pin.

The hammer and breech block are urged in an upward direction toward a rest position by a hammer spring 94 and a main spring 96. The hammer spring is mounted on a guide 97 and a strut 98 which slides telescopically within the guide. The guide has an enlarged semispherical head 99 at its lower end which is received in a socket 101 of corresponding contour in a bracket 102 that is affixed to the lower portion of the grip. The upper portion of strut 98 is received in a slot 104 on the lower side of the hammer and is pivotally connected to the hammer by a pin 106 which passes through holes 107, 108 in the hammer and strut. Hammer spring 94 is constrained between the lower surface of the hammer and an annular shoulder 109 on the upper side of the enlarged head 99 of guide 97.

Main spring 96 is mounted on a guide 111 and a strut 112 which slides telescopically within the guide. This guide has an enlarged semispherical head 113 which is received in a socket 114 to the rear of socket 101 in bracket 102. The upper portion of strut 112 is bifurcated or forked to form a yoke having a pair of arms 116 which extend in an upward direction from a base 117. Aligned holes 118 are provided toward the upper ends of the yoke arms, and the outer ends of pin 83 extend through those holes to connect the strut to the breech block. Spring 96 is constrained between the lower side of base 117 and an annular shoulder 119 on the upper side of the enlarged head of guide 111.

A cocking lever 121 is provided at the lower and of the grip for manually moving the hammer between its rest and cocked positions. The lever is mounted on a pivot pin 122 which extends through holes 123, 124 toward the rear of the grip and the lever, with front end of the lever projecting beyond the front of the grip. A hook 126 is pivotally connected to the lever for engagement with the upper side of the base 117 of the fork on strut 112. The lower portion of the hook extends into a slot 127 on the upper side of the lever, and the hook is connected to the lever by a pin 128 which passes through holes 129, 131 in the hook and lever. The point at which the hook is connected to the lever is about one-third the distance between pivot pin 122 and the front end of the lever, and the cocking lever therefore provides a mechanical advantage of about 3:1 in compressing main spring 96 and hammer spring 94.

A latch 132 releasably holds the cocking lever in its retracted rest position to prevent accidental cocking and discharge of the gun. The latch has an operating button 133 which is disposed in a recessed area on the under side of the lever and a hook 136 which extends through an opening 137 in the lever for engagement with a lip 138 toward the front of the grip. The latch is mounted on a pivot pin 141 which passes through holes 142, 143 in the latch and lever, with the latch being urged in a counterclockwise direction toward its engaged position by a compression spring 144 disposed between the button and the body of the lever.

The hammer is locked in the cocked position by a sear 146 which is rotatively mounted on a pin 147 in a chamber 148 between cavity 14 and trigger guard 13, with the pin passing through aligned holes 149 in the receiver on opposite sides of the sear. The sear has a tooth 150 which engages a radial shoulder 151 on a generally cylindrical head 152 on the hammer. The generally cylindrical head is centered about the shaft 59 on which the hammer rotates, and the sear is biased into engagement with the surface of the head by a spring 153.

An operating rod 154 is pivotally connected to the sear by a pin 156 which passes through holes 157, 158 in the rod and sear. The rod has an enlarged head 159 at its front end and an enlarged block 161 at its rear end, with spring 153 being mounted on the rod and being compressed between the front side of the block and the rear side of a retaining plate 162 which is mounted in a fixed position in the receiver. The rod passes through a vertical slot 163 in the plate, with the spring bearing against the face of the plate on either side of the slot.

A trigger 164 is mounted in an inverted position toward the rear of trigger guard 13 on a pin 166 which passes through aligned holes 167, 168 in the trigger and guard, with the lower portion of the trigger extending into a slot 169 in the guard. A disconnector 171 is connected to the trigger by a pivot pin 172 which passes through aligned holes 173, 174 in the disconnector and trigger. The disconnector extends to the rear of the trigger and has a forwardly facing shoulder 175 on its upper side for engagement with the back side of the enlarged head 159 on operating rod 154. The disconnector extends through a horizontal slot 176 in retaining plate 162, with sufficient clearance to allow up and down movement of the disconnector.

The trigger is biased in a forward direction and the disconnector is biased in an upward direction by a spring 177 mounted in a bore 178 in the trigger guard. A pin 179 carried by the spring has a rounded head which engages the disconnector below pivot pins 166 and 172. Forward travel of the trigger is limited by a stop 180, and upward travel of the disconnector is limited by engagement with the operating rod. A heel 181 on the rear side of the trigger engages the disconnector and pushes it down to disengage the disconnector from the rod after the trigger and the disconnector have travelled far enough to disengage the sear from the hammer.

A magazine 183 is mounted above the barrel and extends into an opening 184 in the receiver above the grip for supplying cartridges to the action. The magazine is removably mounted to the barrel and receiver with a quick-release mechanism 185 of conventional design. The magazine has an internal spring 186 which is constrained by a stationary stop 187 at its forward end and has a block 188 attached to its rear end for pushing the cartridges toward a loading position at the rear of the magazine. The cartridges in the magazine are inclined in a forward direction at an angle such that the axis of each cartridge is parallel to the axis of chamber bore 39 when the chamber body is in the loading position.

In the embodiment illustrated, the cartridges are arranged in a straight line within the magazine. However, since the magazine is outside the receiver, it can be made wider, and the cartridges can be staggered within it to provide a greater holding capacity. With a six inch barrel and a magazine with staggered cartridges, for example, the gun can accommodate 21 rounds in the magazine, plus one in the chamber. The magazine is removably mounted, and magazines of any desired length and capacity can be interchanged along with the barrels.

A loader arm 191 is pivotally mounted in the upper portion of the receiver to the rear of the magazine. This arm is mounted on a pin 192 which passes through holes 193, 194 in the arm and the receiver, and it extends into the rear portion of the magazine by a distance sufficient for engagement the rearmost cartridge in the magazine to push it down into the chamber. The arm is operably connected to breech block 37 by a spring 196 and a guide rod 197. The guide rod is pivotally connected to the breech block by a pin 198 which passes through holes 199, 201 in the guide rod and breech block. The spring extends coaxially about the guide rod and is attached to a hook 202 toward the lower end of the rod. The upper end of the rod bears against the lower side of the loader arm to return the arm to its rest position once a cartridge has been loaded into the chamber.

A next round stopper 203 is mounted above the loader arm for preventing another cartridge from being delivered to the loading position when the loader arm is out of its rest position. The stopper is mounted on the same pivot pin 192 as the loader arm, and has a pair of depending flanges 204 which straddle the rear portion of the loader arm, with the pin extending through aligned holes 206 in the flanges. The stopper extends a short distance to the rear of the pin, and a spring 207 positioned beneath the rear portion urges the front end of the stopper in a downward direction. A cover 208 is mounted on the receiver over the loading mechanism and secured to the receiver by screws 209. The back end of the stopper abuts against the lower side of the cover to limit travel of the stopper in that direction.

Openings 211, 212 and 213 are formed in breech block 37, hammer 38 and cocking lever 121, respectively, to provide a passageway through which spent shells are ejected from the gun.

A single sight 214 is mounted in a fixed position on cover 208 toward the rear of the gun.

Figure 9:
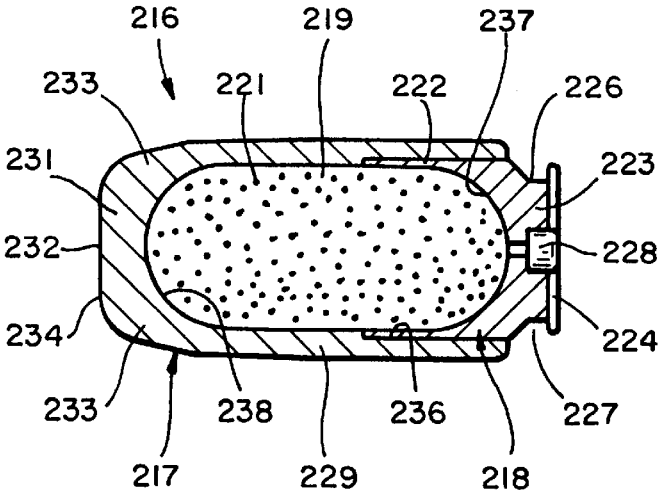
FIG. 9 is an enlarged cross-sectional view of one embodiment of a cartridge which is particularly suitable for use in the embodiment of FIG. 1.

A preferred embodiment of a cartridge 216 for use in the gun is illustrated in FIG. 9. This cartridge has a hollow projectile 217 which mounts over the outside of a case 218, with the entire chamber 219 formed by the projectile and case being filled with gunpowder 221. In the preferred embodiment, both the projectile and the case are fabricated of brass, although either or both can be made of another suitable material, if desired.

The case has a cylindrical side wall 222 with an end wall or head 223 toward the rear of the cartridge. The head has a radially extending flange 224, with a section of lesser diameter 226 forming a groove 227 between the flange and the side wall. A primer 228 is mounted centrally of the head for igniting the powder when struck by the firing pin.

The projectile has a generally cylindrical side wall 229 and a nose 231 which has a flat, circular central area 232, a tapered and rounded section 233 between the side wall and the flat area, and a cutting edge 234 formed by the corner between the flat circular area and the rounded section. The inner side of side wall 229 is stepped, with a section of larger diameter 236 toward the rear. The side wall of the case fits into that section, with the step corresponding to the thickness of the case wall and the inner surfaces of the two walls being substantially flush with each other. The inner surfaces 237, 238 of case head 223 and the nose of the projectile are rounded or semispherical, and the rear portion of side wall 229 has a larger outer diameter than the front.

Figure 10:
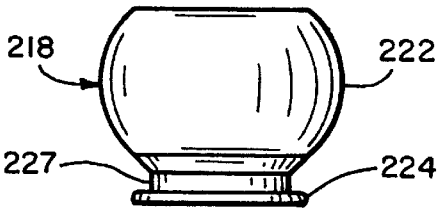
FIG. 10 is a side elevational view of the case in the embodiment of FIG. 9 after the cartridge has been fired.
Figure 2A:
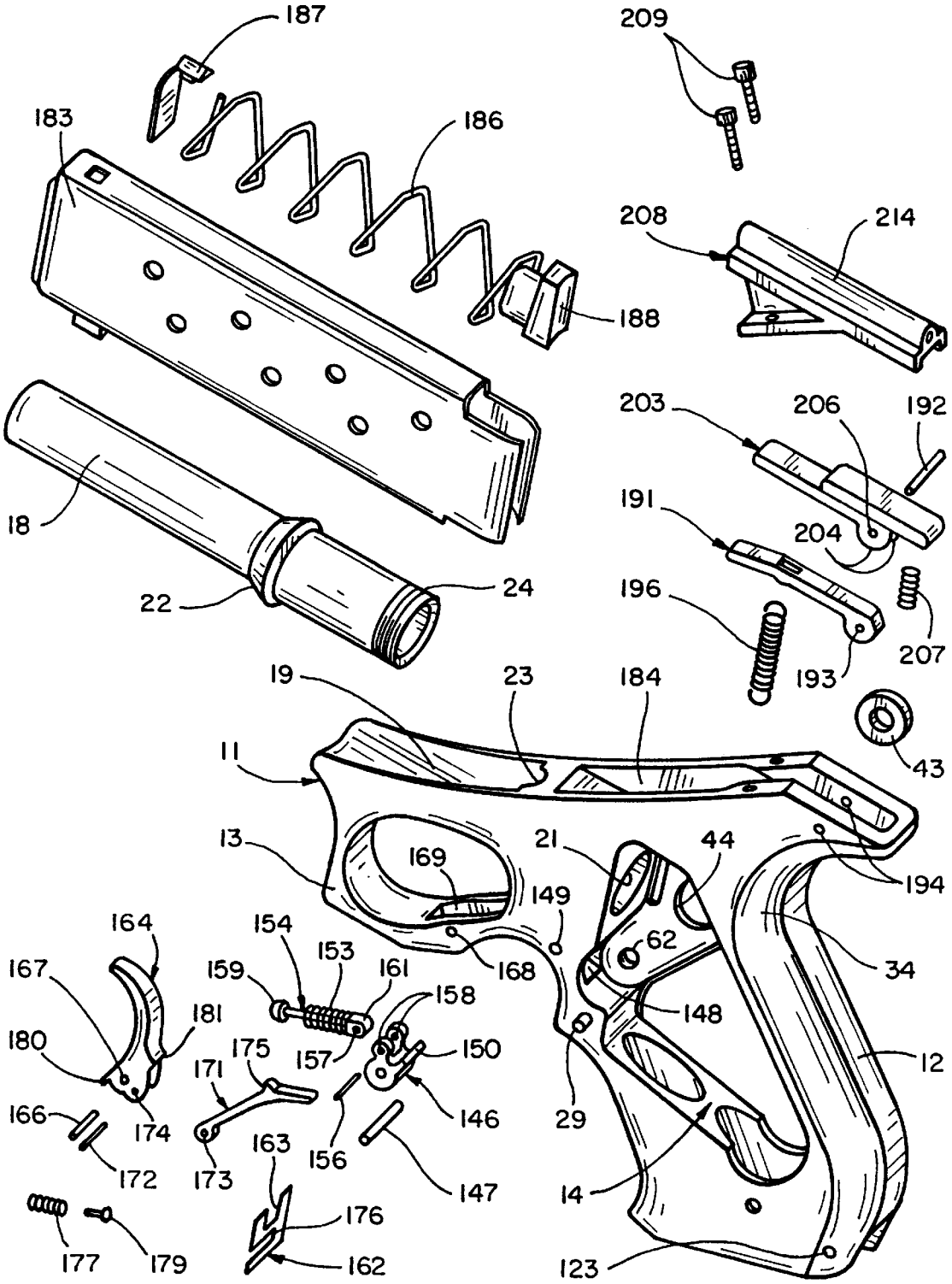
FIGS. 2A and 2B are an exploded perspective view of the embodiment of FIG. 1.
Figure 2B:
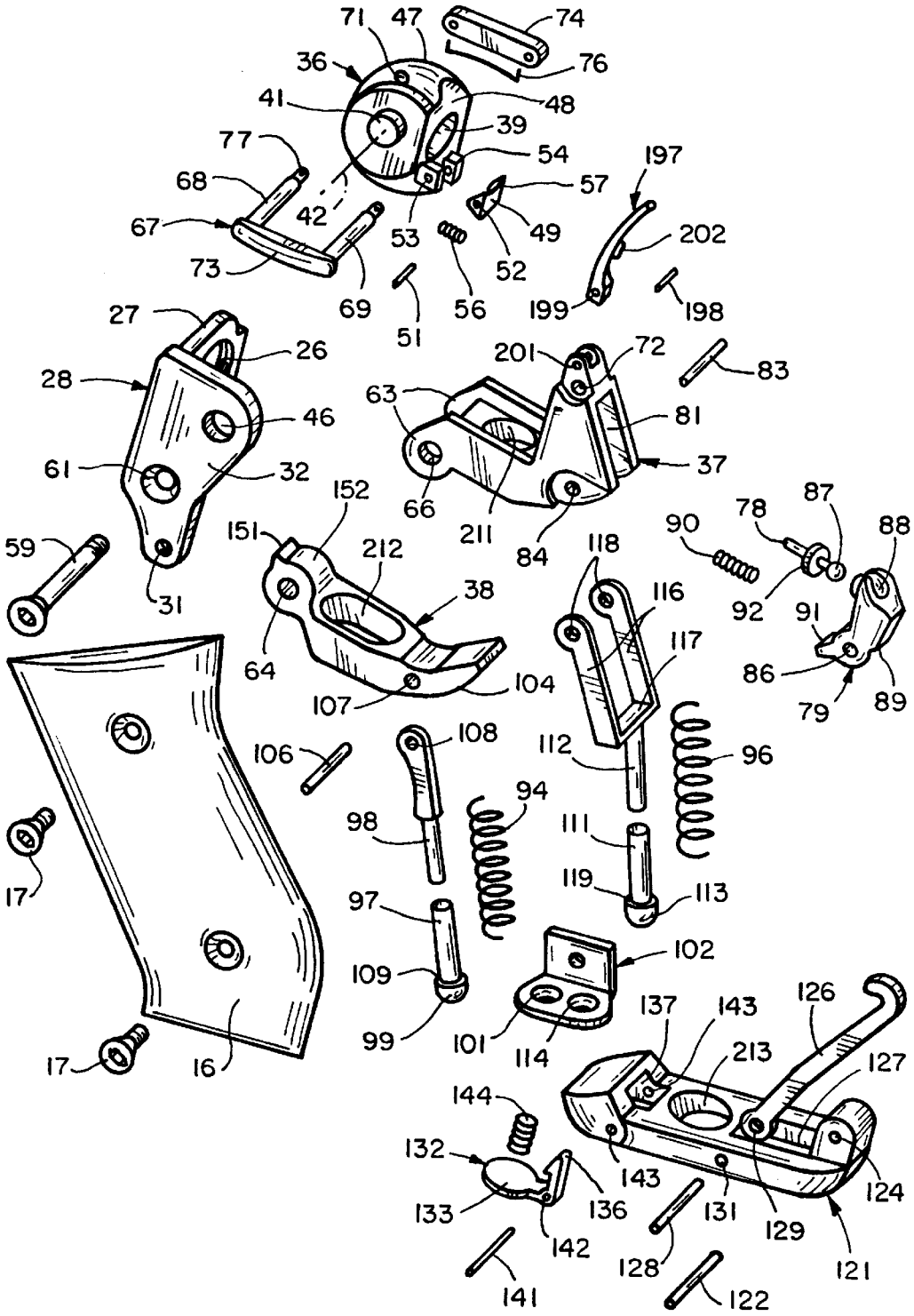
Figure 3:
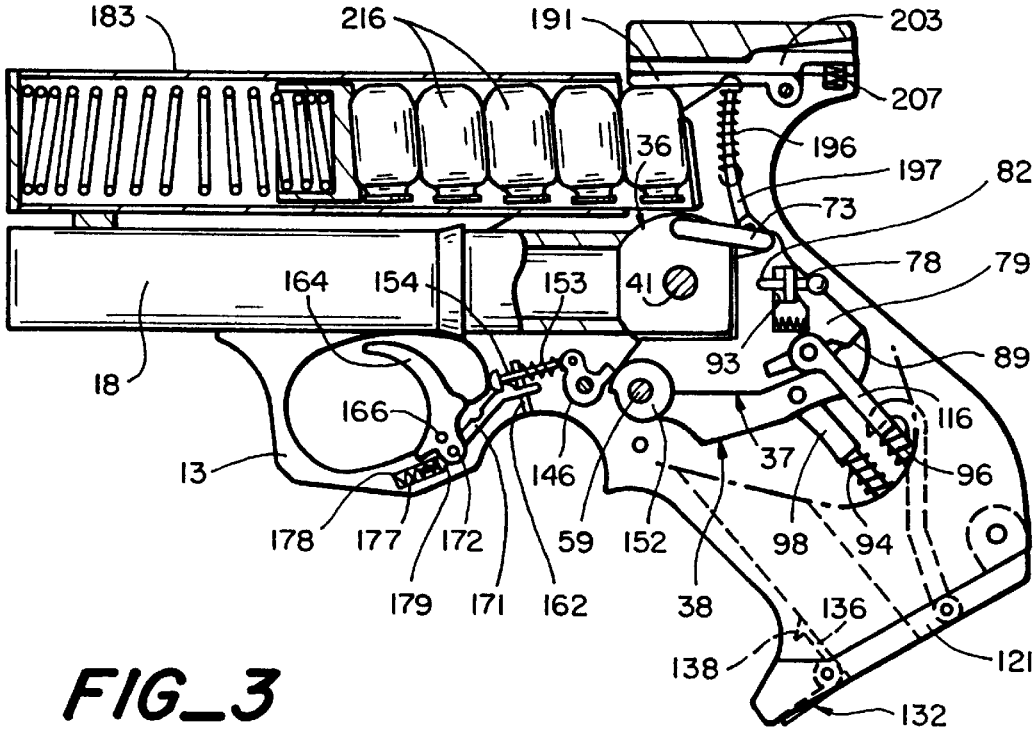
FIGS. 3–8 are cross-sectional views of the embodiment of FIG. 1 with the action in different operating positions.

The flange on the case head is of smaller diameter than the projectile. In one presently preferred embodiment for use in a .45 caliber gun, the projectile has an outer diameter of 0.45 inches, and the case is of a size normally used in 9 mm cartridges. That provides a difference in diameter of about 0.096 inch, or approximately 21 percent, between the projectile and the flange. Because of this difference, the side wall 222 of the case is free to expand when the cartridge is fired, and it tends to swell or bow outwardly, as illustrated in FIG. 10.

Operation and use of the gun is as follows. In the rest position illustrated in FIG. 3, hammer spring 94 and main spring 96 are extended, holding hammer 38 and breech block 37 in their uncocked or rest positions, with the hammer resting against the lower surface 89 of firing pin carrier 79. Chamber body 36 is locked in its horizontal or battery position by the breech block, and sear 146 rests against the cylindrical surface 152 at the front of the hammer. Trigger 164 is held in its rest position by spring 177, with disconnector 171 resting against operating rod 154. With the action in the rest position, a magazine 183 holding a plurality of cartridges 216 is installed, and loader arm 191 is positioned above the rearmost cartridge in the magazine.

The gun is cocked by disengaging latch 132 and pulling cocking lever 121 in a downward direction. As the cocking lever swings down, hook 126 pulls down on strut 112, rotating breech block 37 in a downward or clockwise direction, compressing main spring 96. As the breech block swings down, it bears against hammer 38, causing the hammer to rotate in a downward or clockwise direction, compressing hammer spring 94. Chamber 36 also rotates with the breech block, turning in a clockwise direction as the breech block moves down. As the action reaches the end of its rotation, the tooth 150 on the sear engages the shoulder 151 on the hammer, locking the hammer in the cocked position. When the cocking lever is returned to its rest position, spring 96 returns the breech block to its rest position, and the chamber body returns to the battery position.

Figure 4:
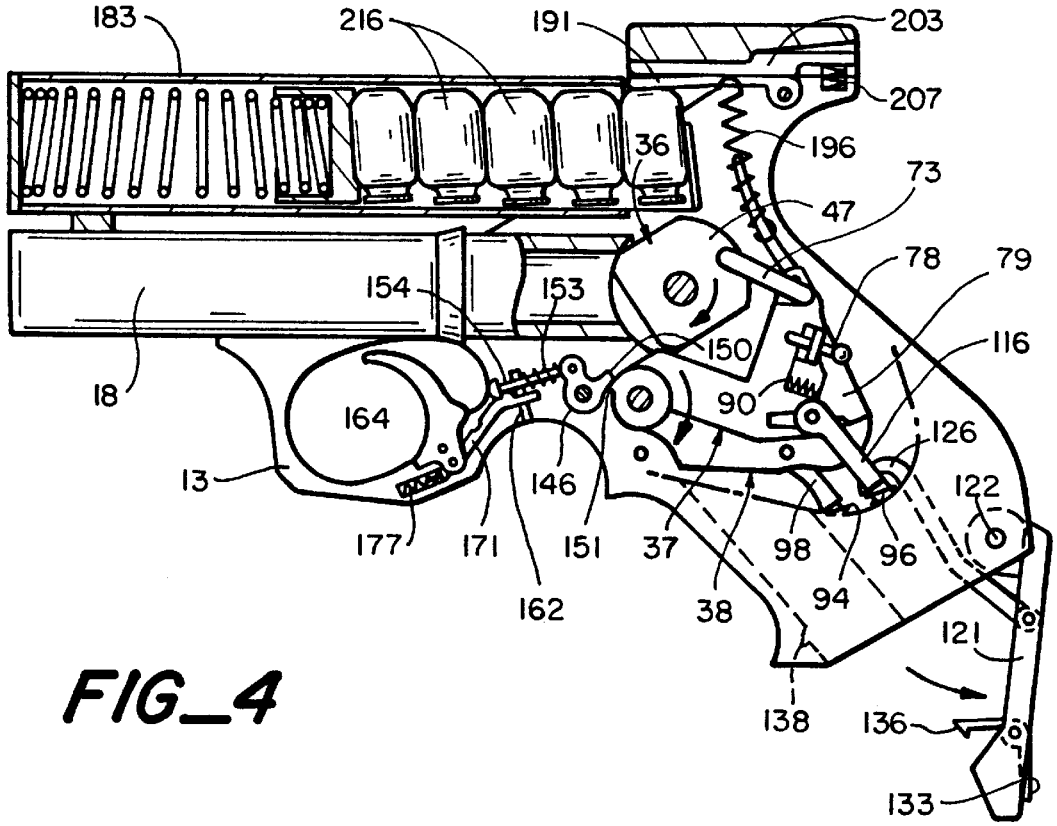

FIG. 4 illustrates the action in a partially cocked position, with the chamber body rotated part way between its battery and loading position, the breech block rotated part way between its rest and cocking positions, and the hammer rotated part way between its rest and cocked positions.

Figure 5:
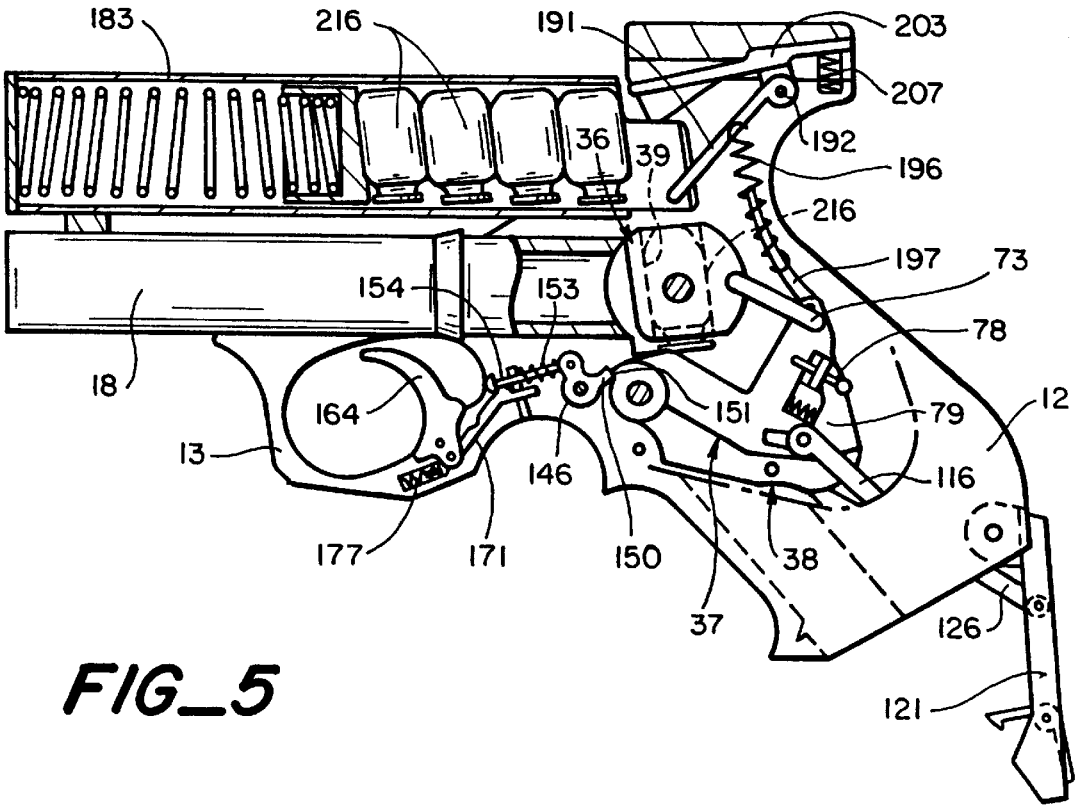

FIG. 5 shows the action in the fully cocked position, with chamber body in its loading position, the breech block in its cocking position, the hammer in its cocked position and the sear engaged with the hammer.

Figure 6:
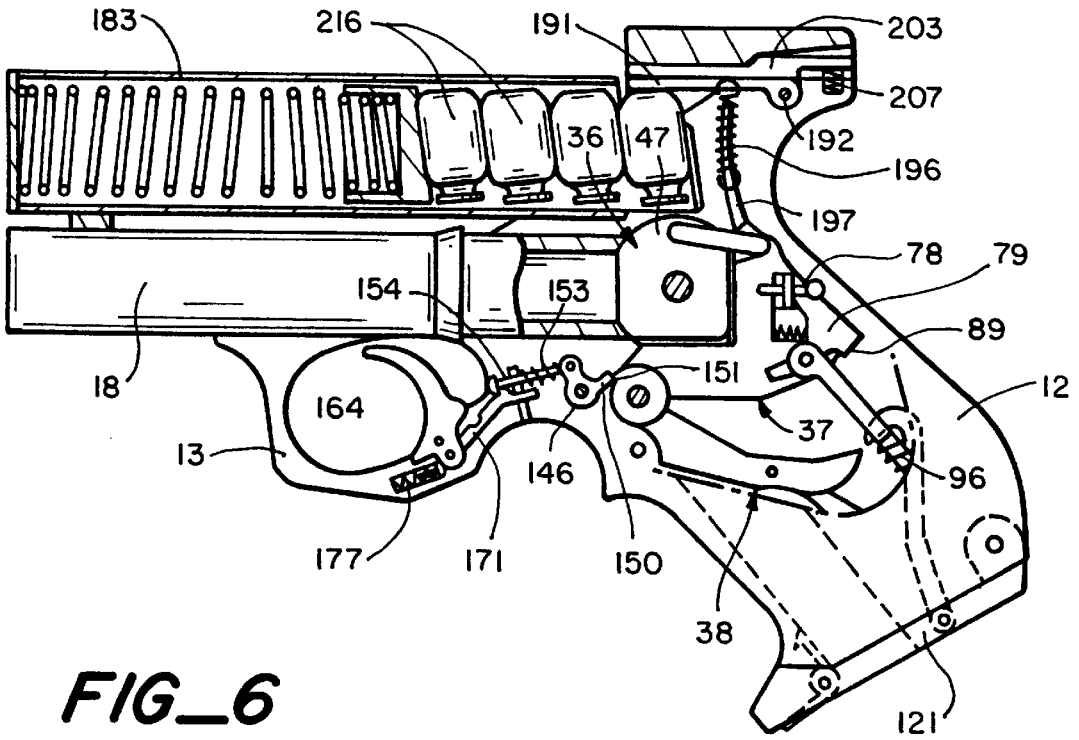

FIG. 6 illustrates the action in the firing position with the chamber body in the battery position, the breech in its rest position, and the hammer in its cocked position.

As the breech block swings down, spring 196 is elongated, pulling loader arm 191 down against the top of the rearmost cartridge in the magazine. The cartridge is thus pushed down toward the chamber body, with head of the case bearing against the outer surface 47 of the chamber body as the chamber body rotates toward its loading position, as illustrated in FIG. 4.

When the chamber body reaches the loading position, the cartridge is pushed into the chamber bore 39, as illustrated in FIG. 5, with shell holder 49 riding over flange 224 and snapping into groove 227 to prevent further downward movement of the cartridge. Forward movement of the cartridge within the chamber bore is prevented by abutment of the shell holder against the flat surface 48 of the chamber body. When the loader arm starts to move the cartridge down into the chamber, next round stopper 203 swings down and blocks the next cartridge in the magazine from moving into the loading position.

As the breech block swings back toward its rest position and the chamber body rotates toward the battery position, the upper end of guide rod 197 engages the under side of loader arm 191, pushing that arm and next round stopper 203 back to their rest positions and allowing the next cartridge in the magazine to move into the loading position, as illustrated in FIG. 6.

If a spent shell is in the chamber at the time a new cartridge is loaded, the force of the new cartridge entering the chamber pushes the spent shell out of the chamber and ejects it out of the gun through the openings 211, 212 in the breech block and hammer. If the cocking lever is down, as it is when the gun is being cocked manually, the spent shell passes out through the opening at the bottom of the grip. If the cocking lever is up, as it is when the cocking occurs automatically, the shell passes out of the grip through the opening 213 in the cocking lever. If desired, the spent shells can be collected in a bag or other suitable shell catcher (not shown) beneath the grip.

Figure 7:
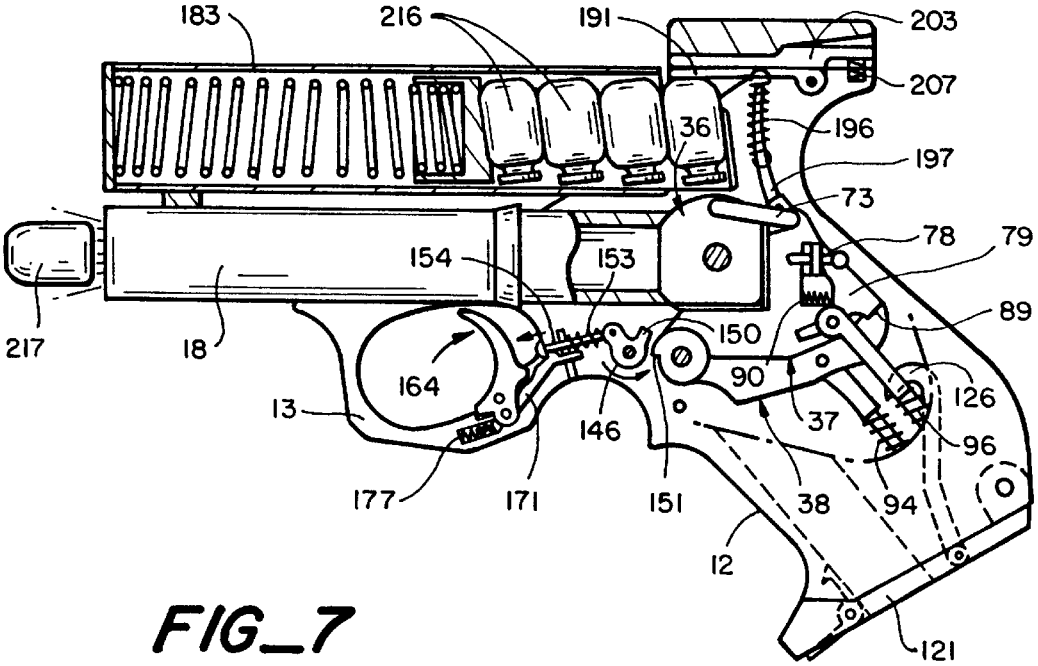

The gun is fired by pulling back on trigger 164 when the hammer is in the cocked position. As illustrated in FIG. 7, when the trigger is pulled, disconnector 171 draws operating rod 154 in a forward direction, causing the sear to rotate in a counterclockwise direction. Rotation of the sear disengages tooth 150 from the shoulder 151 on the hammer, releasing the hammer to be driven in an upward direction by hammer spring 94. When the hammer impacts upon the lower surface 89 of firing pin carrier 79, the carrier rotates, driving the firing pin 78 into the primer to fire the cartridge in the chamber.

Figure 8:
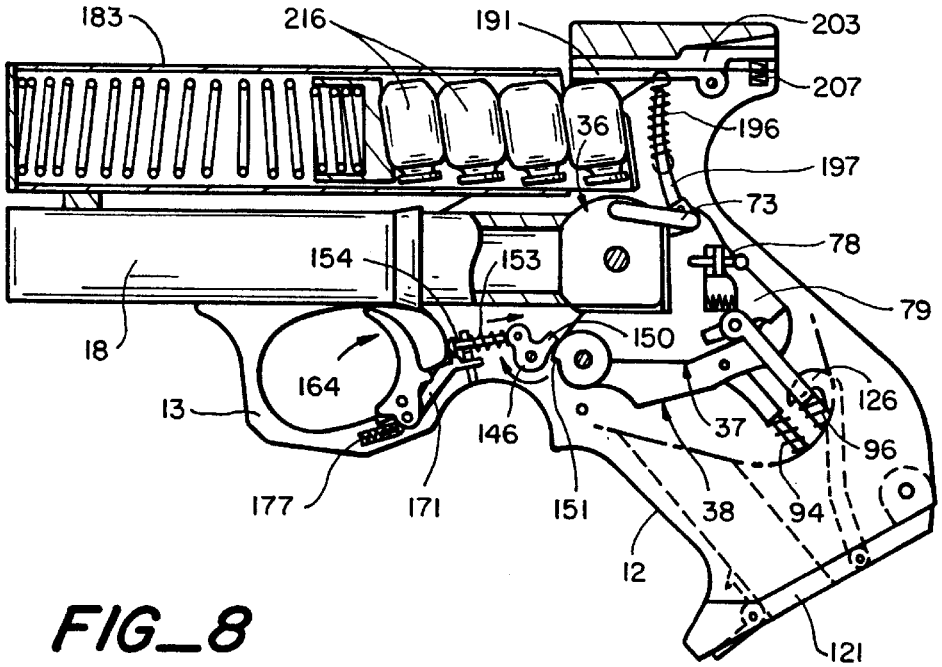

As the trigger moves beyond the point at which the hammer is released, the heel 181 of the hammer depresses the disconnector and disengages it from operating rod 154, thereby releasing the rod so that spring 153 can move the sear back into engagement with the surface of the hammer, as illustrated in FIG. 8. When the trigger is released, it returns to its rest position under the urging of spring 177, and the disconnector pivots back up into engagement with the operating rod.

Blow-back from the discharge of the cartridge in the chamber causes the action to rotate just as it does when the cocking lever is pulled, thereby cocking the hammer, loading a new cartridge, and expelling the spent shell from the chamber. The gun thus fires in a semiautomatic mode, firing once each time the trigger is pulled until the last cartridge in the magazine has been fired.

The gun can be uncocked with a round in the chamber by holding the cocking lever down, pulling back on the trigger to release the hammer, and then using the cocking lever to slowly return the hammer and breech block to their rest positions.

Figure 11:
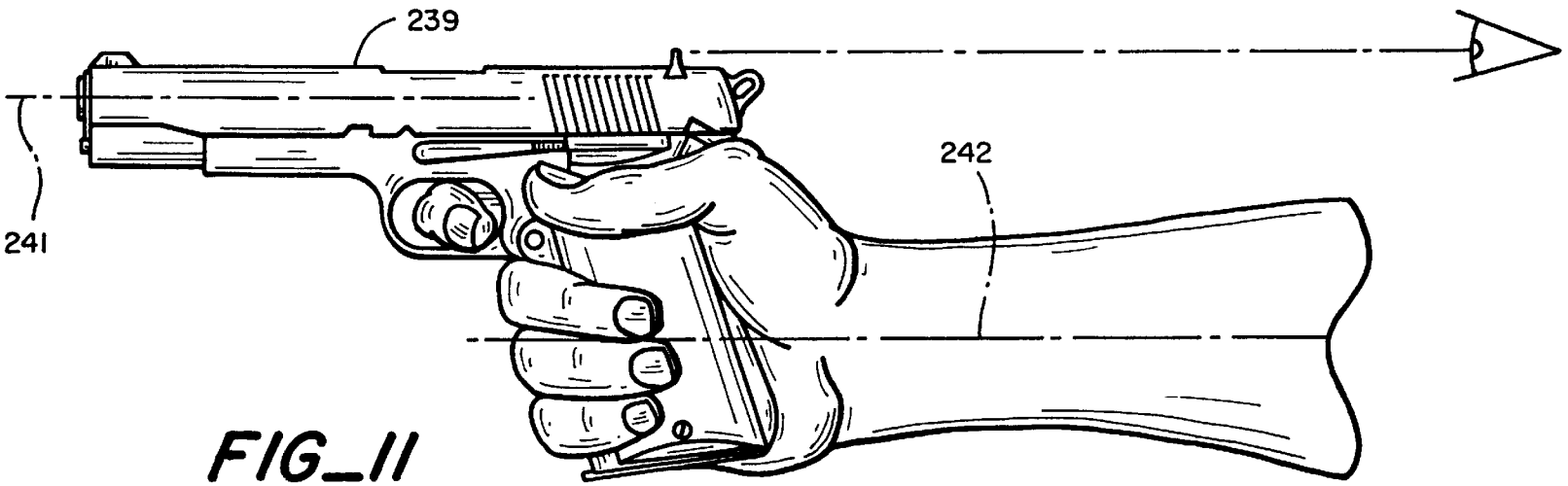
FIGS. 11 and 12 are side elevational views of a semiautomatic pistol of conventional design in the hand of a shooter, illustrating the barrel rise which occurs when that gun is fired.
Figure 12:
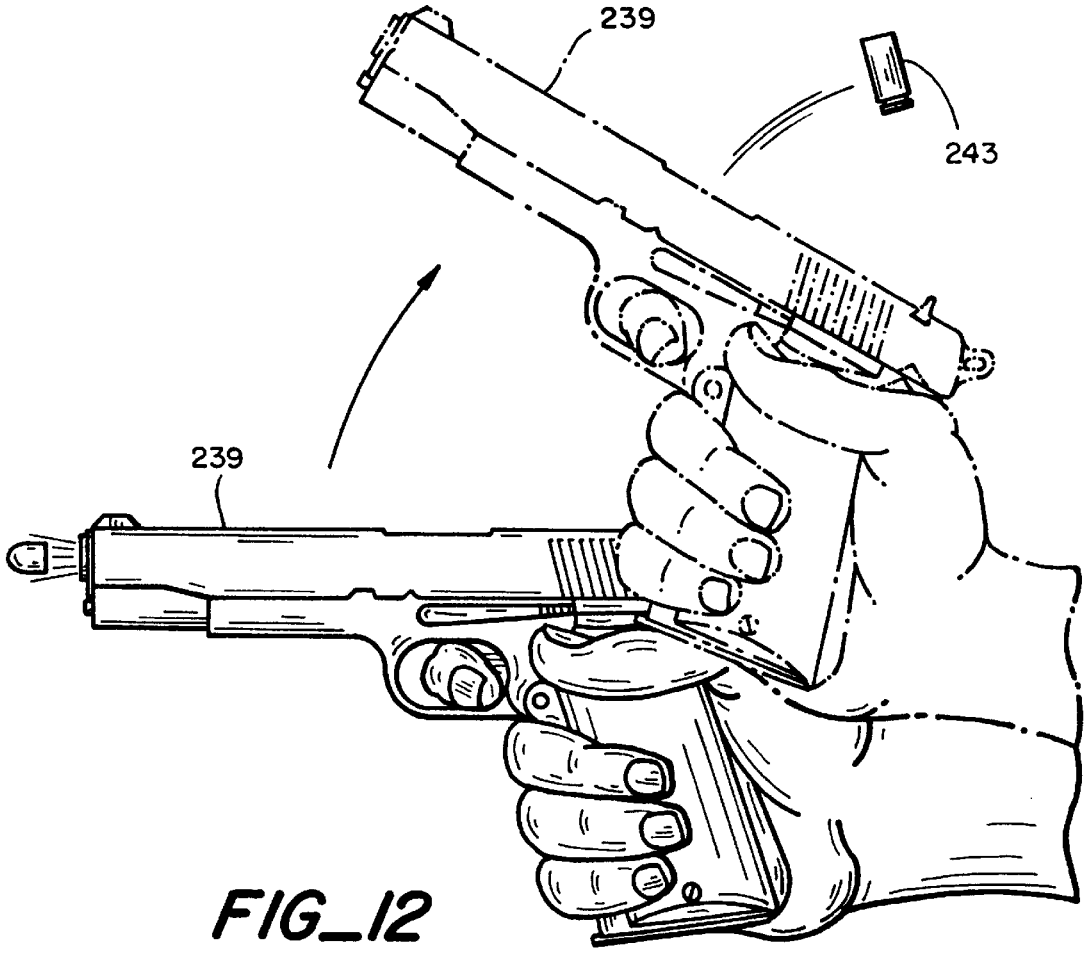

As noted above, the invention has a significant advantage over semiautomatic pistols of more conventional design in that barrel rise is completely eliminated. As illustrated in FIG. 11, when a Model 1911 or other conventional semiautomatic pistol 239 is held in the firing position, wrist of the shooter is cocked up, and the axis 241 of the barrel is spaced a substantial distance above the axis 242 of the shooter's forearm. When the gun is discharged, the recoil force applies a substantial moment of force to the shooter's arm, causing the arm to swing in an upward direction, as illustrated in FIG. 12, and producing in a significant rise in the barrel of the gun. At the same time, the spent round 243 is ejected through the top of the gun and can be distracting to the shooter.

Figure 13:
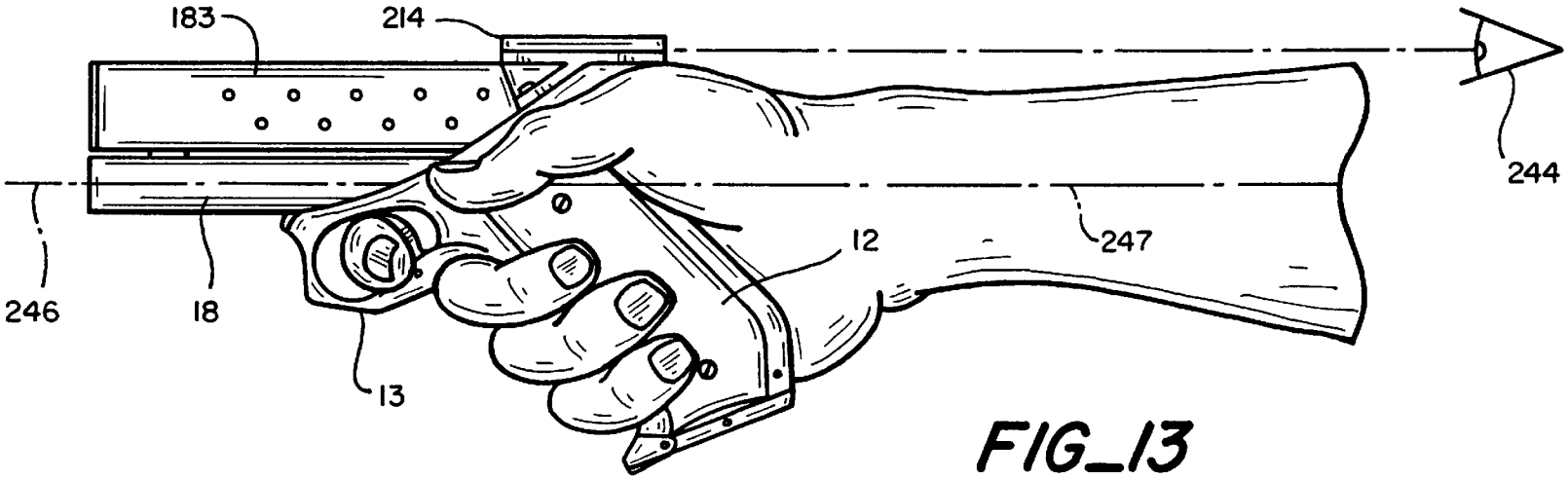
FIGS. 13 and 14 are views similar to FIGS. 11 and 12, illustrating the manner in which the semiautomatic pistol of the invention is held and fired without barrel rise.

Referring now to FIG. 13, which shows the gun of the invention in the hand of the shooter, the position and angle of the barrel 18 relative to the grip 12 are such that shooter's wrist is locked in a down position, with the top of the wrist level with the top of the forearm and the arm. The top of the arm is also substantially level with the sight 214 on the gun, and when the shooter's eye 244 is aligned with the sight, the shooter is looking straight down the top of the arm, with the arm acting as an extension of the sight. This extended sight not only provides greater accuracy but also permits quicker placement of shots.

Figure 14:
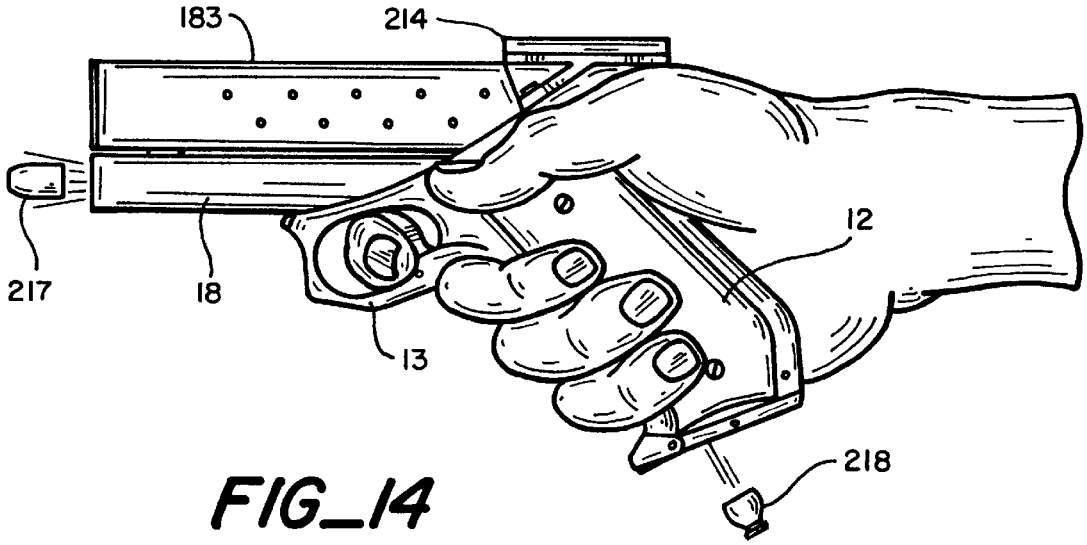

The axis 246 of the barrel is in direct alignment with the axis 247 of the forearm, and the recoil force is applied directly to the axis of the forearm and wrist, with no tendency for either the arm or the barrel to rise. The gun thus remains in the firing position, as illustrated in FIG. 14, and the spent case 218 is ejected in a downward direction from the bottom of the grip where it will not distract the shooter and can be easily collected. The gun will remain in that position no matter how many rounds are fired, with no tendency to rise or climb even when successive rounds are fired rapidly.

The recoil force of the gun is partially absorbed by the cartridges 216 and the spring 186 in magazine 183. Because of their vertical orientation and inertia, the cartridges tend to remain in place as the gun recoils, thereby compressing spring and causing it to absorb a portion of the force of the recoil.

The impact of the discharge on the body of the shooter is further reduced by expansion of the case in the chamber of the gun. This results from the difference in diameters between the chamber bore and the case and the case of the cartridge and is made possible by having the side wall of the projectile outside the side wall of the case. As discussed above and illustrated in FIG. 10, the side wall 222 of the case expands in a radial direction, perpendicular to the axis of the barrel. This softens the impact of the explosion which is transmitted to the shooter, making the gun feel more gentle or "polite".

If desired, conventional cartridges can be used in the gun instead of the cartridge disclosed herein. However, since conventional cartridges are longer than the disclosed cartridge, the gun will need to have a larger chamber and greater chamber and breech movement in order to accommodate them. The disclosed cartridges are preferred for use in this gun and others because of their smaller size, lighter weight, higher muzzle velocity, and their ability to absorb some of the impact of detonation.

The invention has a number of important features and advantages. It provides a compact, lightweight, rapid cycling, highly accurate firearm which has and enormous stopping power. The action is completely contained within the grip, and the barrel is aligned directly with the wrist and forearm of the shooter, thereby eliminating barrel rise and providing a more natural and stable shooting posture. The sight is fixed, and the shooter's arm serves as an extension of the sight, providing greater accuracy and allowing quicker placement of shots.

There is no slide mechanism, and the barrel is mounted in a stable, fixed position instead of floating within a slide. Since spent rounds are ejected through the bottom of the grip, rather than in the shooter's face, they do not distract the shooter and can be collected in a simple container.

With the removable barrel and the magazine mounted above the barrel, the gun can accommodate barrels of any desired length and magazines of any desired capacity.

There are no external moving parts other than the trigger and the cocking lever. With the action fully enclosed, breech discharge flash is reduced and the chances of contaminants being introduced into the firing mechanism is greatly reduced. This permits greater concealment and reduces the chances of the gun becoming jammed or otherwise malfunctioning in the field.

With the components of the action being rotatively mounted and positioned close together, the amount of movement is greatly reduced as compared with the slide action in a conventional gun. This results in reduced wear, faster cycling, and a more reliable action.

This gun has fewer components than other automatic and semiautomatic weapons, making it easier to assemble and disassemble.

In addition, a person can easily see whether there is a live round in the chamber, making this gun much safer to handle than other automatic and semiautomatic guns. With the magazine removed and the action rotated to the loading position, a person can look through either the top or the bottom of the grip and directly into the chamber to see if there is a cartridge in it.

The hollow projectile is substantially lighter and faster than the solid bullet of a conventional cartridge. In a .45 caliber cartridge, for example, the hollow projectile weighs only about 100 grains whereas the slug or bullet in a conventional cartridge weighs about 230 grains. The case of the cartridge is also substantially smaller and lighter than the case of a conventional cartridge of similar caliber, and the overall weight of the present cartridge is on the order of only one half the weight of the conventional cartridge. This significantly reduces the weight of the gun and permits a greater number of cartridges to be carried.

The hollow projectile also permits the use of a larger charge of powder than a conventional cartridge since the powder can fill substantially the entire interior of the cartridge. Combined with the lighter weight of the hollow projectile, the larger charge provides a higher muzzle velocity and a hitting power comparable to that of a heavier bullet of conventional design. Thus, for example, a .45 caliber bullet manufactured in accordance with the invention has a muzzle velocity of about 1500 feet per second, as contrasted with about 950 feet per second for a standard .45 caliber bullet.

When the projectile strikes a target at an angle, the cutting edge formed by the corner at the periphery of the flat central area hits the target first and tends to cut into the target rather than glancing off as a rounded or more pointed nose would do. In addition, a substantial vacuum forms behind the hollow, fast moving projectile as it travels through the air. When the projectile passes through a body, the vacuum draws tissue from the body behind it, giving the cartridge even greater destructive power.

Being shorter than cartridges of conventional design, the cartridge with the hollow projectile minimizes the size of the chamber and the amount of chamber and breech movement required in the gun.

It is apparent from the foregoing that a new and improved firearm and cartridge have been provided. While only certain presently preferred embodiments have been described in detail, as will be apparent to those familiar with the art, certain changes and modifications can be made without departing from the scope of the invention as defined by the following claims.

I claim:

1. In a hand-held firearm: a grip adapted to be held in the hand of a shooter, a barrel extending in a forward direction from the grip, a magazine of cartridges positioned above the barrel, an action located within the grip for firing cartridges through the barrel, means for transferring a cartridge from the magazine to the action, and means for ejecting a spent cartridge case from the action through the lower portion of the grip.

2. The firearm of claim 1 wherein the magazine is aligned with the upper portion of the grip, and the axis of the barrel intersects the grip below the upper portion at an angle such that the barrel will be aligned axially with the forearm of the shooter when the grip is held in the hand with the top of the shooter's wrist level with the top of the forearm.

3. The firearm of claim 1 wherein the action includes a chamber body which rotates about an axis perpendicular to the axis of the barrel between a battery position in which a chamber carried by the body is aligned with the barrel and a loading position in which the chamber is oriented for receiving the cartridge from the magazine.

4. The firearm of claim 3 wherein the action further includes a breech block which is rotatively mounted for movement between rest and cocking positions, a firing pin carried by the breech block, and a hammer movable between rest and cocked positions for driving the firing pin into engagement with a cartridge in the chamber when the chamber body is in the battery position.

5. The firearm of claim 4 including a link interconnecting the chamber body and the breech block so that the chamber body moves between its battery and loading positions as the breech block moves between its rest and cocking positions.

6. The firearm of claim 4 wherein the firing pin is mounted on a carrier which is pivotally mounted on the breech block, and the hammer strikes the carrier to pivot the carrier and thereby drive the firing pin into engagement with the cartridge in the chamber.

7. The firearm of claim 6 wherein the hammer is positioned below the breech block and strikes a surface on the lower side of the firing pin carrier.

8. The firearm of claim 4 including a sear engageable with the hammer for holding the hammer in its cocked position, means yieldably urging the sear into engagement with the hammer, an operating rod connected to the sear, a trigger, and means connected between the trigger and the operating rod for drawing the sear out of engagement with the hammer when the trigger is pulled to a predetermined position.

9. The firearm of claim 8 wherein the means connected between the trigger and the operating rod comprises a disconnector which is pivotally connected to the trigger and releasably engaged with the operating rod, and the trigger includes means operable upon pulling of the trigger beyond the predetermined position for disengaging the disconnector from the operating rod so the sear can return to engagement with the hammer.

10. The firearm of claim 8 wherein the trigger is mounted in an inverted position for movement about an axis toward the bottom of the trigger.

11. The firearm of claim 4 including a cocking lever pivotally connected to the lower portion of the grip and operably connected to the breech block for moving the breech block between its rest and cocking positions, the hammer being positioned beneath the breech block and being moved toward its cocked position by movement of the breech block.

12. The firearm of claim 1 wherein the action comprises a chamber body movable between a battery position and a loading position, and the means for transferring a cartridge from the magazine to the action comprises a loader arm positioned above the rearmost cartridge in the magazine, and means responsive to rotation of the action for moving the loader arm in a downward direction to push the rearmost cartridge into a chamber in the chamber body when the chamber body has moved to its loading position.

13. The firearm of claim 12 wherein the means for moving the loader arm includes a spring connected to the arm and to the action in such manner that spring is pulled upon by the action as the chamber body rotates toward the loading position, the spring pulling down on the arm to urge the rearmost cartridge toward the chamber body, with the cartridge resting against the periphery of the chamber body while the chamber body is rotating and being pushed into the chamber when the chamber body reaches the loading position.

14. The firearm of claim 3 wherein the chamber has a bore of predetermined diameter in which the cartridge is received, and the cartridge has a case with a side wall of lesser diameter than the bore, a projectile having a side wall disposed coaxially about the side wall of the case and a hollow nose extending forwardly of the side walls, and a powder charge filling substantially the entire region within the case and the projectile.

15. The firearm of claim 14 wherein the nose of the cartridge has a flat central area and a circular cutting edge extending peripherally of the central area.

16. In a firearm: a barrel, a chamber body rotatable between a battery position in which a chamber carried by the body is aligned with the barrel and a loading position, a breech block rotatable between a rest position and a cocking position, means interconnecting the chamber body and the breech block so that the chamber body moves between the battery and loading positions as the breech block moves between its rest and cocking positions, a hammer rotatable between rest and cocked positions, the hammer being moved toward its cocked position by movement of the breech block toward its cocking position, means urging the breech block and the hammer toward their rest positions, means for retaining the hammer in its cocked position while permitting the breach block to return to its rest position, and means for releasing the hammer from its cocked position to fire a cartridge in the chamber when the chamber body is in the battery position.

17. The firearm of claim 16 wherein the means urging the breech block and the hammer toward their rest positions comprises a first spring which urges the breech block toward its rest position and a second spring which urges the hammer toward its rest position.

18. The firearm of claim 16 including a cocking lever operably connected to the breech block for moving the breech block between its rest position and its cocking position.

19. The firearm of claim 16 including a magazine of cartridges mounted above the barrel, and means for transferring a cartridge from the magazine to the chamber when the chamber body is in the loading position.

20. The firearm of claim 19 wherein the means for transferring the cartridge includes a loader arm positioned above the rearmost cartridge in the magazine, a spring connected between the loader arm and the breech block for pulling down on the arm as the breech block rotates to urge the rearmost cartridge toward the chamber body, the cartridge resting against the periphery of the chamber body while the chamber body is rotating and being pushed into the chamber when the chamber body reaches the loading position.

21. The firearm of claim 16 including a firing pin mounted on a carrier which is pivotally mounted on the breech block and adapted to be struck by the hammer when the hammer is released from its cocked position, with impact of the hammer upon the carrier causing the carrier to pivot and drive the firing pin into engagement with a cartridge in the chamber.

22. The firearm of claim 16 wherein the chamber body is rotatable about an axis which is intersected by the axis of the barrel, and the breech block and the hammer are rotatively mounted on a shaft for rotation about an axis which is spaced from and parallel to the axis about which the chamber body rotates.

23. The firearm of claim 16 including a grip adapted to be held in the hand of a shooter, with the chamber body, the breech block and the hammer all being mounted in the grip.

24. The firearm of claim 23 wherein the barrel extends from the grip at an angle on the order of 130–135 degrees.

25. The firearm of claim 23 including means for ejecting a spent cartridge case from the chamber through the bottom of the grip.

26. The firearm of claim 16 wherein the chamber has a bore of predetermined diameter in which the cartridge is received, and the cartridge has a case with a side wall of lesser diameter than the bore, a projectile having a side wall disposed coaxially about the side wall of the case and a hollow nose extending forwardly of the side walls, and a powder charge filling substantially the entire region within the case and the projectile.

27. The firearm of claim 26 wherein the nose of the cartridge has a flat central area and a circular cutting edge extending peripherally of the central area.

28. In a firearm: a barrel, a breech block rotatable about a first axis perpendicular to the barrel between rest and cocking positions, a chamber body which is operably connected to the breech block for rotation about a second axis perpendicular to the barrel between battery and loading positions as the breech block moves between the rest and cocking positions, and a firing pin carried by the breech block for impacting upon a cartridge carried by the chamber body when the chamber body is in the battery position.

29. The firearm of claim 28 wherein the chamber body includes a chamber which is aligned with the barrel when the chamber body is in the battery position, together with a magazine of cartridges mounted above the barrel, and means for transferring a cartridge from the magazine to the chamber when the chamber body is in the loading position.

30. In a firearm: a breech block rotatable between rest and cocking positions, a chamber body operably connected to the breech block for rotation between battery and loading positions as the breech block moves between the rest and cocking positions, and a firing pin mounted on a carrier which is pivotally connected to the breech block for impacting upon a cartridge in the chamber when the chamber body is in the battery position.

31. The firearm of claim 30 including a hammer for striking the carrier to pivot the carrier and thereby drive the firing pin toward the cartridge in the chamber.

32. In a hand-held firearm: a grip adapted to be held in the hand of a shooter, a barrel extending in a forward direction from the grip, with the axis of the barrel intersecting the grip below the upper portion of the grip at an angle such that the barrel will be aligned axially with the forearm of the shooter when the grip is held in the hand with the top of the shooter's wrist level with the top of the forearm, a magazine of cartridges positioned above the barrel, an action for firing cartridges through the barrel, means for transferring a cartridge from the magazine to the action, and means for ejecting a spent cartridge case from the action.

* * * * *